US005600892A

United States Patent [19]

Peugh et al.

[11] Patent Number: 5,600,892

[45] Date of Patent: Feb. 11, 1997

[54] DUAL SIDE DRYWALL PANEL CUTTER

[76] Inventors: Glenn H. Peugh, 1021 Glendale Dr., Arcata, Calif. 95521; David A. Daniel, 3441 G St., Eureka, Calif. 95503; Gary O. Pritchett, 2353 Fickle Hill Rd., Arcata, Calif. 95521

[21] Appl. No.: 457,120

[22] Filed: Jun. 1, 1995

[51] Int. Cl.[6] ..... B26B 29/06

[52] U.S. Cl. ..... 30/292; 30/293; 30/294; 83/883

[58] Field of Search ..... 83/614, 51, 522.19, 83/468, 745, 885, 468.7, 883; 30/292, 293, 294

[56] References Cited

U.S. PATENT DOCUMENTS

| | | | |
|---|---|---|---|
| 381,752 | 4/1888 | Beach | 83/468.7 |
| 390,515 | 10/1888 | Owen | 83/468 |
| 1,424,050 | 7/1922 | Thomas et al. | 83/455 |
| 2,529,210 | 11/1950 | Butler | 83/883 |
| 3,807,269 | 4/1974 | Mertes | 83/468 |
| 3,889,862 | 6/1975 | Insolio et al. | 83/614 |
| 4,614,138 | 9/1986 | Altman | 83/51 |
| 5,027,515 | 7/1991 | Murdock | 83/885 |
| 5,408,909 | 4/1995 | Suk | 83/614 |
| 5,488,773 | 2/1996 | Fletcher | 30/294 |

FOREIGN PATENT DOCUMENTS

| | | | |
|---|---|---|---|
| 911178 | 2/1961 | United Kingdom | 83/51 |

*Primary Examiner*—Kenneth E. Peterson
*Assistant Examiner*—Sean A. Pryor

[57] ABSTRACT

A cutter for simultaneously severing opposed sides of a drywall panel. The inventive device includes a guide assembly for sliding along an exposed edge of a drywall panel. Support columns project from the guide assembly for positioning along respectively opposed front and rear faces of the panel. Cutting assemblies are secured to lower ends of the support columns and engage the faces of the panel to effect cutting of the panel along a line parallel to the exposed edge as the guide assembly is traversed thereover.

1 Claim, 5 Drawing Sheets

DUAL SIDE DRYWALL PANEL CUTTER

BACKGROUND OF THE INVENTION

1. Field of the Invention

The present invention relates to cutting devices and more particularly pertains to a dual side drywall panel cutter for simultaneously severing opposed sides of a drywall panel.

2. Description of the Prior Art

The use of cutting devices is known in the prior art. More specifically, cutting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art cutting devices include U.S. Pat. No. 4,876,789; U.S. Pat. No. 5,193,279; U.S. Pat. No. 4,713,887; U.S. Pat. No. 4,325,188; U.S. Pat. No. 4,181,054; and U.S. Pat. No. Des. 334,540.

While these devices fulfill their respective, particular objectives and requirements, the aforementioned patents do not disclose a dual side drywall panel cutter for simultaneously severing opposed sides of a drywall panel which includes a guide assembly for sliding along an exposed edge of a drywall panel, support columns projecting from the guide assembly for positioning along respectively opposed front and rear faces of the panel, and cutting assemblies secured to the lower ends of the support columns for engaging the faces of the panel to effect cutting of the panel along a line parallel to the exposed edge as the guide assembly is traversed thereover.

In these respects, the dual side drywall panel cutter according to the present invention substantially departs from the conventional concepts and designs of the prior art, and in so doing provides an apparatus primarily developed for the purpose of simultaneously severing opposed sides of a drywall panel.

SUMMARY OF THE INVENTION

In view of the foregoing disadvantages inherent in the known types of cutting devices now present in the prior art, the present invention provides a new dual side drywall panel cutter construction wherein the same can be utilized for simultaneously severing opposed sides of a drywall panel. As such, the general purpose of the present invention, which will be described subsequently in greater detail, is to provide a new dual side drywall panel cutter apparatus and method which has many of the advantages of the cutting devices mentioned heretofore and many novel features that result in a dual side drywall panel cutter which is not anticipated, rendered obvious, suggested, or even implied by any of the prior art cutting devices, either alone or in any combination thereof.

To attain this, the present invention generally comprises a cutter for simultaneously severing opposed sides of a drywall panel. The inventive device includes a guide assembly for sliding along an exposed edge of a drywall panel. Support columns project from the guide assembly for positioning along respectively opposed front and rear faces of the panel. Cutting assemblies are secured to lower ends of the support columns and engage the faces of the panel to effect cutting of the panel along a line parallel to the exposed edge as the guide assembly is traversed thereover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dual side drywall panel cutter apparatus and method which has many of the advantages of the cutting devices mentioned heretofore and many novel features that result in a dual side drywall panel cutter which is not anticipated, rendered obvious, suggested, or even implied by any of the prior art tool guides, either alone or in any combination thereof.

It is another object of the present invention to provide a new dual side drywall panel cutter which may be easily and efficiently manufactured and marketed.

It is a further object of the present invention to provide a new dual side drywall panel cutter which is of a durable and reliable construction.

An even further object of the present invention is to provide a new dual side drywall panel cutter which is susceptible of a low cost of manufacture with regard to both materials and labor, and which accordingly is then susceptible of low prices of sale to the consuming public, thereby making such dual side drywall panel cutters economically available to the buying public.

Still yet another object of the present invention is to provide a new dual side drywall panel cutter which provides in the apparatuses and methods of the prior art some of the advantages thereof, while simultaneously overcoming some of the disadvantages normally associated therewith.

Still another object of the present invention is to provide a new dual side drywall panel cutter for simultaneously severing opposed sides of a drywall panel.

Yet another object of the present invention is to provide a new dual side drywall panel cutter which includes a guide assembly for sliding along an exposed edge of a drywall panel, support columns projecting from the guide assembly for positioning along respectively opposed front and rear faces of the panel, and cutting assemblies secured to the lower ends of the support columns for engaging the faces of the panel to effect cutting of the panel along a line parallel to the exposed edge as the guide assembly is traversed thereover.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1A:
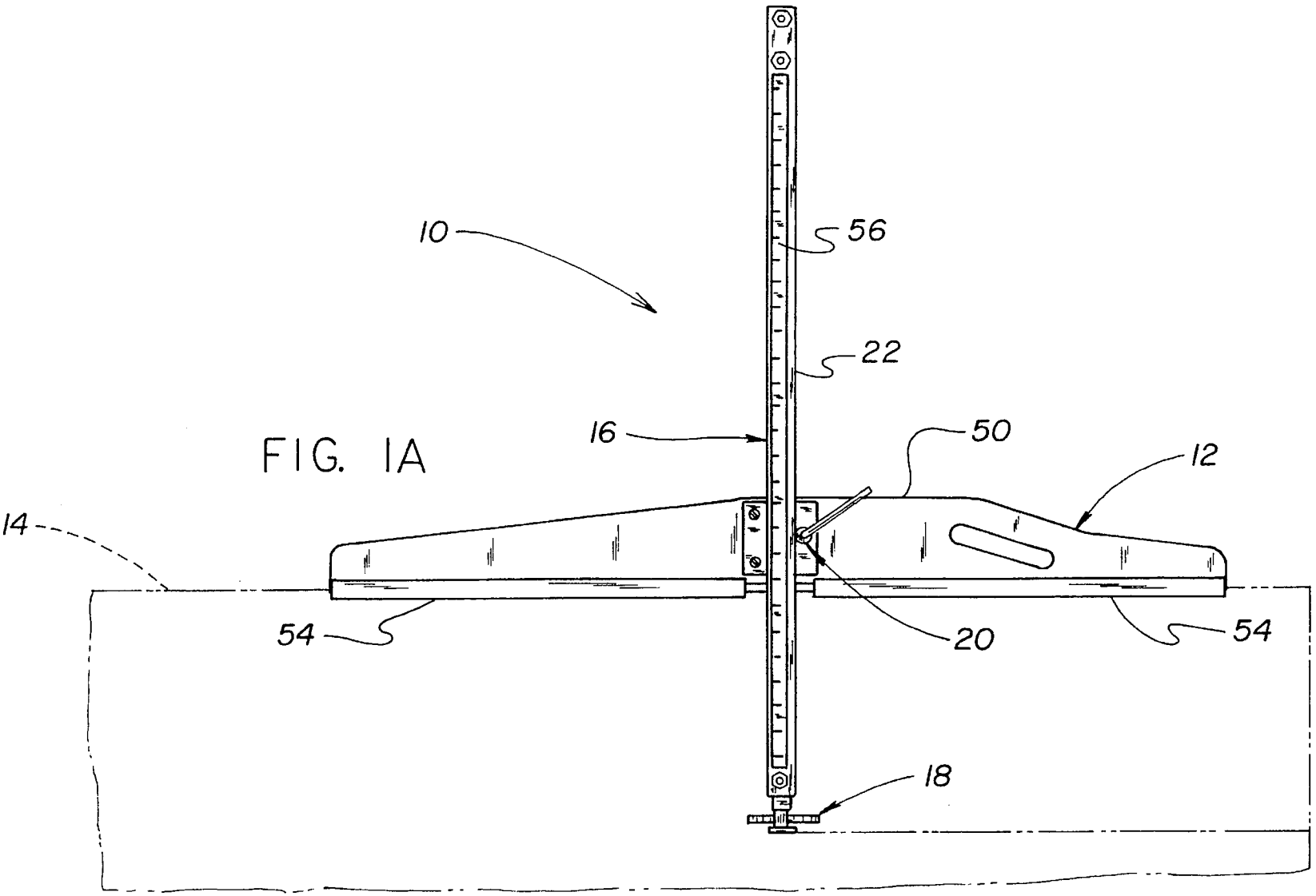
FIG. 1A is a front elevation view of a dual side drywall panel cutter according to the present invention in use.
Figure 1B:
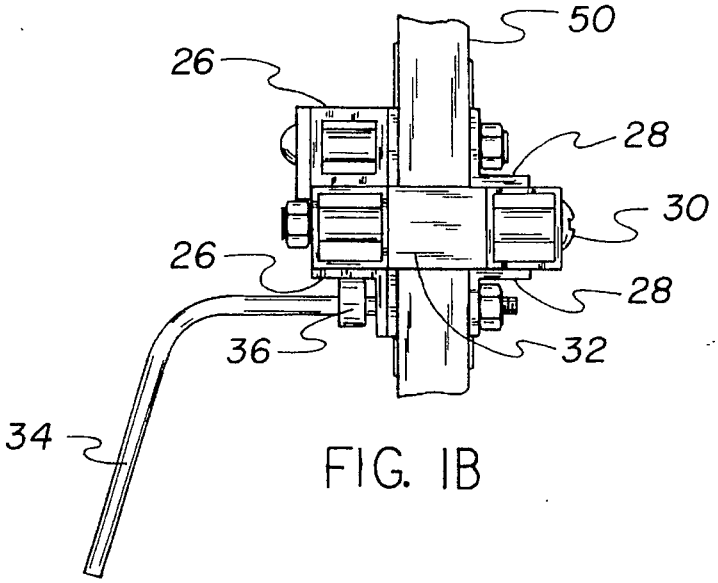
FIG. 1B is a top plan view of the invention.

With reference now to the drawings, and in particular to FIGS 1A–9 thereof, a dual side drywall panel cutter embodying the principles and concepts of the present invention and generally designated by the reference numeral 10 will be described.

More specifically, it will be noted that the dual side drywall panel cutter 10 comprises a guide means 12 for positioning along an exposed edge of a drywall panel 14, as shown in FIG. 1A of the drawings. A support assembly 16 is adjustably coupled to the guide means 12 and extends downwardly therefrom so as to be positionable along opposed faces of the drywall panel 14. Cutting means 18 are secured to lower ends of the support assembly 16 for engaging and cutting opposed faces of the drywall panel 14. By this structure, the drywall panel 14 can be cut along a line substantially parallel to an exposed edge to which the guide means 12 is abuttingly engaged and traversed over.

As shown in FIG. 1A the cutting means 18 is supported by the support assembly 16 a predetermined distance from the guide means 12. Preferably, the support assembly 16 is movably mounted relative to the guide means 12, with the present invention 10 further comprising a clamp means 20 for selectively securing a position of the support assembly 16 relative to the guide means 12.

As best illustrated in FIGS. 1B through 7, it can be shown that the support assembly 16 according to the present invention 10 preferably comprises a first support column 22 slidably mounted to a front face of the guide means 12. A second support column 24 is slidably mounted to a rear face of the guide means 12. To this end, a first pair of flanges 26 are secured to the front face of the guide means 12 in a substantially spaced and parallel orientation, with the first support column 22 extending therebetween. Similarly, a second pair of flanges 28 are secured to the rear face of the guide means 12 in a substantially spaced and parallel orientation, with the second support column 24 extending therebetween. The support columns 22 and 24 are joined together at upper ends thereof by at least one upper fastener 30 directed therebetween. Preferably, a spacing block 32 is interposed between the upper ends of the support columns 22 and 24 so as to position the support columns a predetermined distance apart to accommodate the guide means 12 therebetween.

Figure 6:
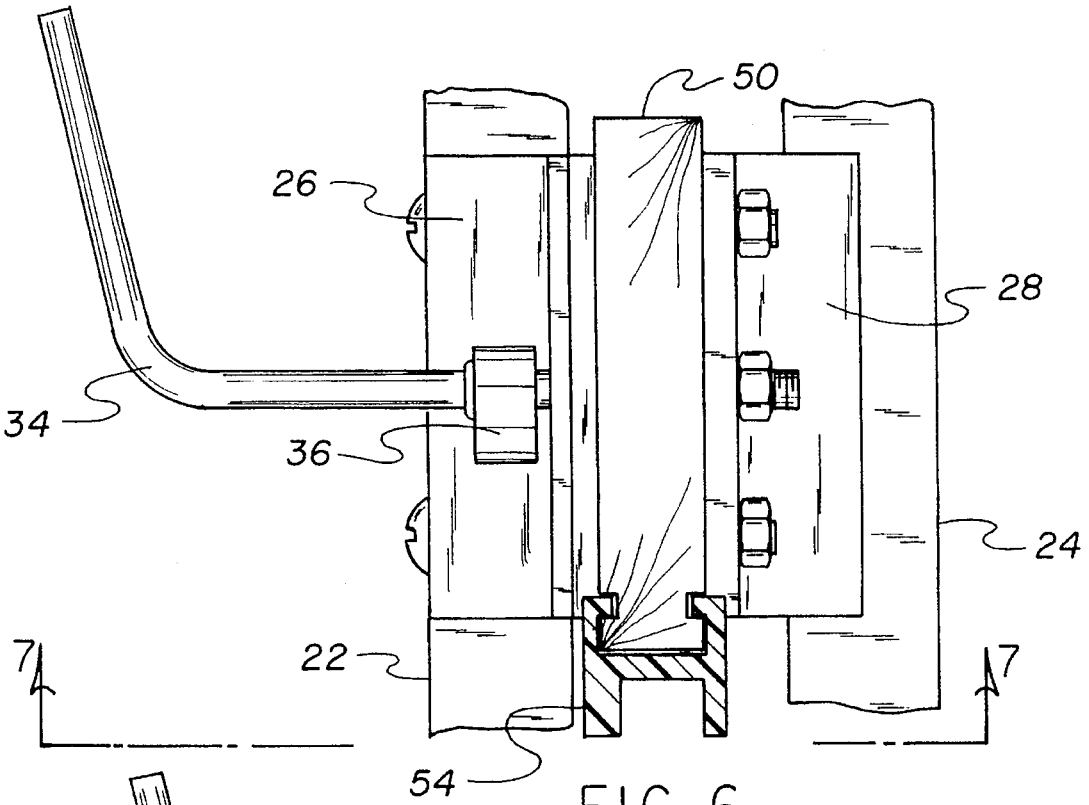
FIG. 6 is a side elevation, partially in cross section, of the present invention.
Figure 7:
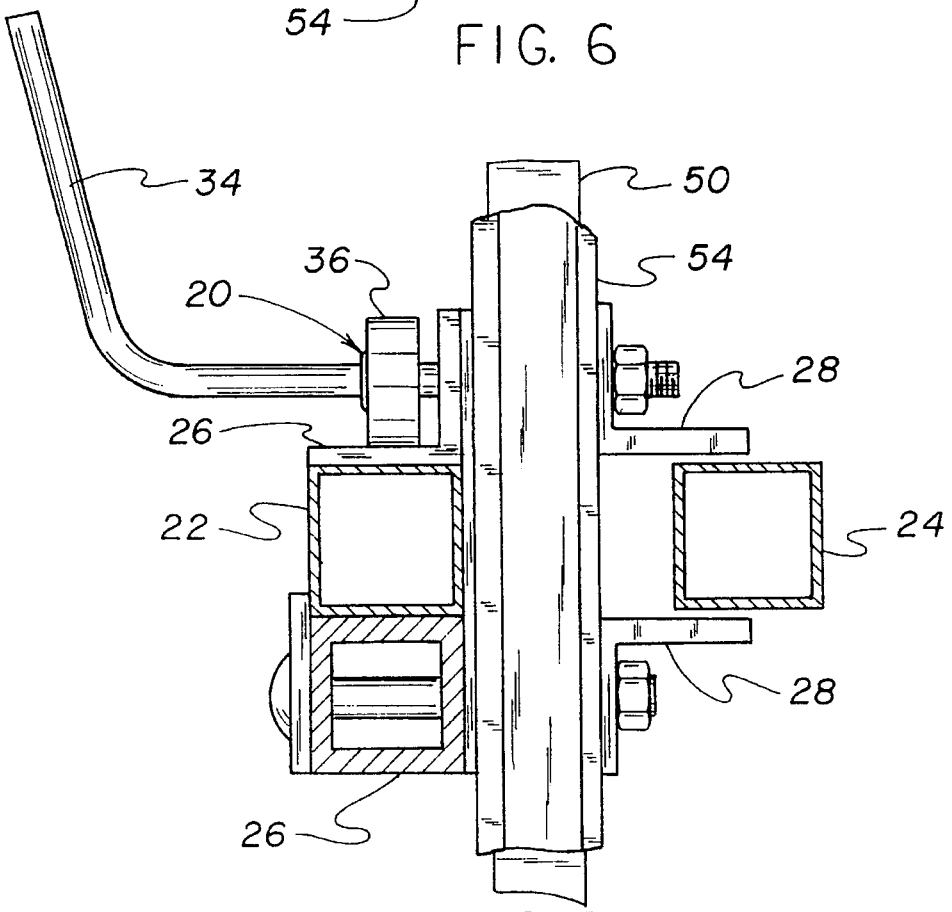
FIG. 7 is a cross sectional view taken along line 7—7 of FIG. 6.

To facilitate securement of the support assembly 16 in a desired orientation relative to the guide means 12, the clamp means 20 of the present invention 10 preferably comprises a lock lever 34 pivotally mounted relative to the guide means 12. A cam 36 is fixedly secured to the lock lever 34 and positioned for engagement against one of the first pair of flanges 26 such that a rotation of the lock lever 34 will engage the cam 36 to bias the first pair of flanges 26 together and clamp the first support column 22 therebetween, as shown in FIGS. 6 and 7 of the drawings.

Figure 8:
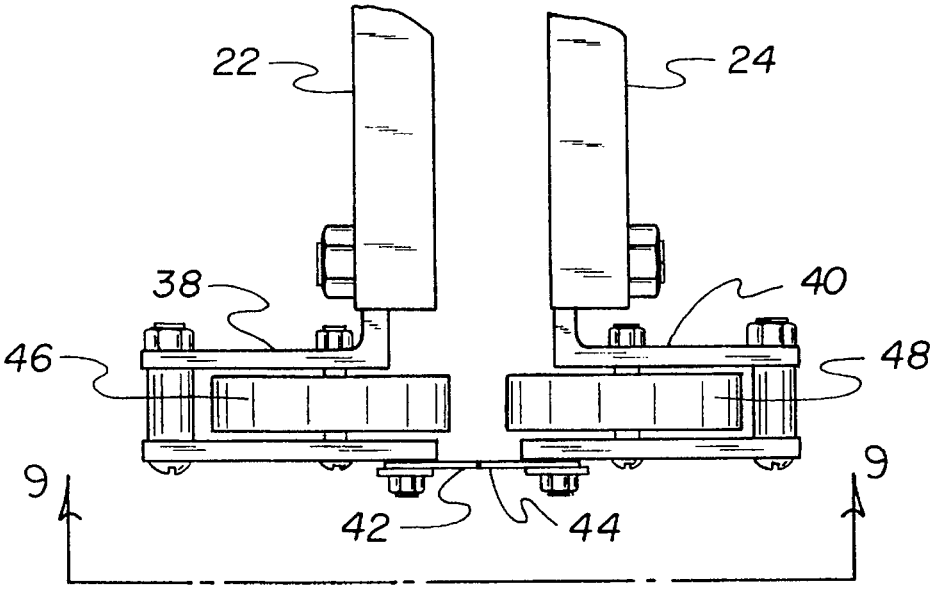
FIG. 8 is a side elevation of a cutting means comprising a portion of the present invention.
Figure 9:
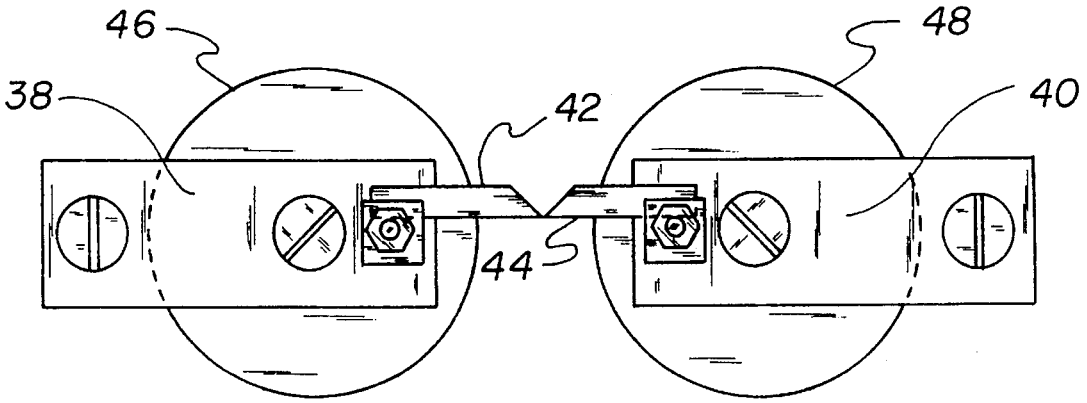
FIG. 9 is a plan view taken from line 9—9 of FIG. 8.

Referring now to FIGS. 8 and 9, it can be shown that the cutting means 18 according to the present invention 10 preferably comprises a first blade mounting bracket 38 secured to a lower end of the first support column 22. Similarly, a second blade mounting bracket 40 is secured to a lower end of the second support column 24. A first cutting blade 42 is secured to the first blade mounting bracket 38 and positioned for engagement against a front face of the drywall panel 14 when the device 10 is positioned as illustrated in FIG. 1A of the drawings. Similarly, a second cutting blade 44 is secured to the second blade mounting bracket 40 and oriented so as to project towards the first cutting blade 42 so as to engage a rear face of the drywall panel 14. Preferably, the cutting blades 42 and 44 are adjustably coupled to the respective mounting brackets 38 and 40 such that a distance therebetween can be selectively varied as determined by an end user. To maintain the cutting blades 42 and 44 in an aligned orientation during cutting of a drywall panel 14, as well as to restrain the paper webs of the front and rear faces of the panel 14 during cutting thereof, the cutting means 18 may further comprise a first guide wheel 46 rotatably mounted to the first blade mounting bracket 38 and positioned for rolling engagement with the front face of the drywall panel 14. Similarly, a second guide wheel 48 can be provided with the cutting means 18 and rotatably mounted to the second blade mounting bracket 40 so as to be positioned for rolling engagement with a rear face of the drywall panel 14. By this structure, a forced positioning of a drywall panel 14 between the support columns 22 and 24 will effect cutting thereof by the cutting blades 42 and 44 along a predetermined line dictated by the engagement of the guide means 12 against an exposed edge of the drywall panel 14.

Figure 1C:
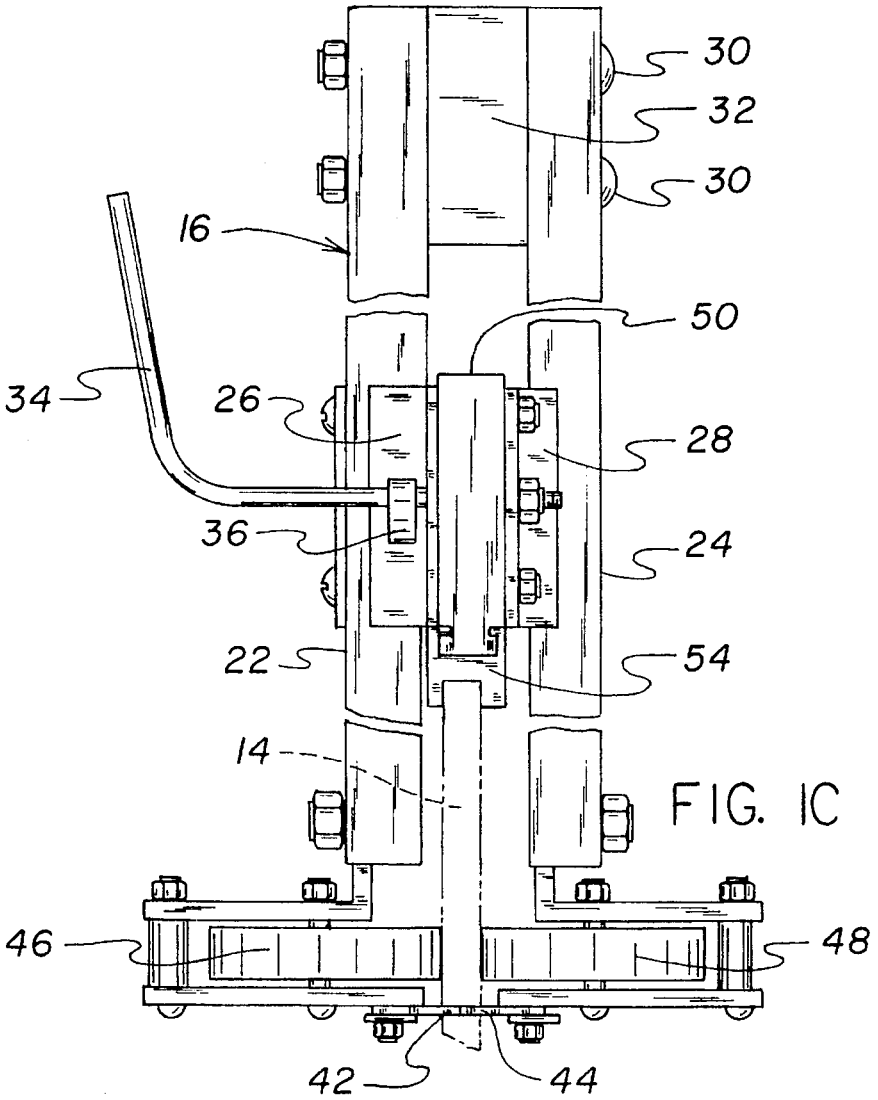
FIG. 1C is a side elevation of the present invention in use.
Figure 3:
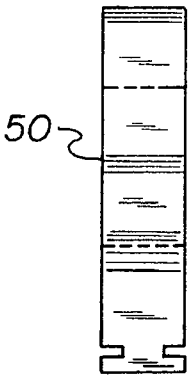
FIG. 3 is a side elevation view taken from line 3—3 of FIG. 2.
Figure 2:
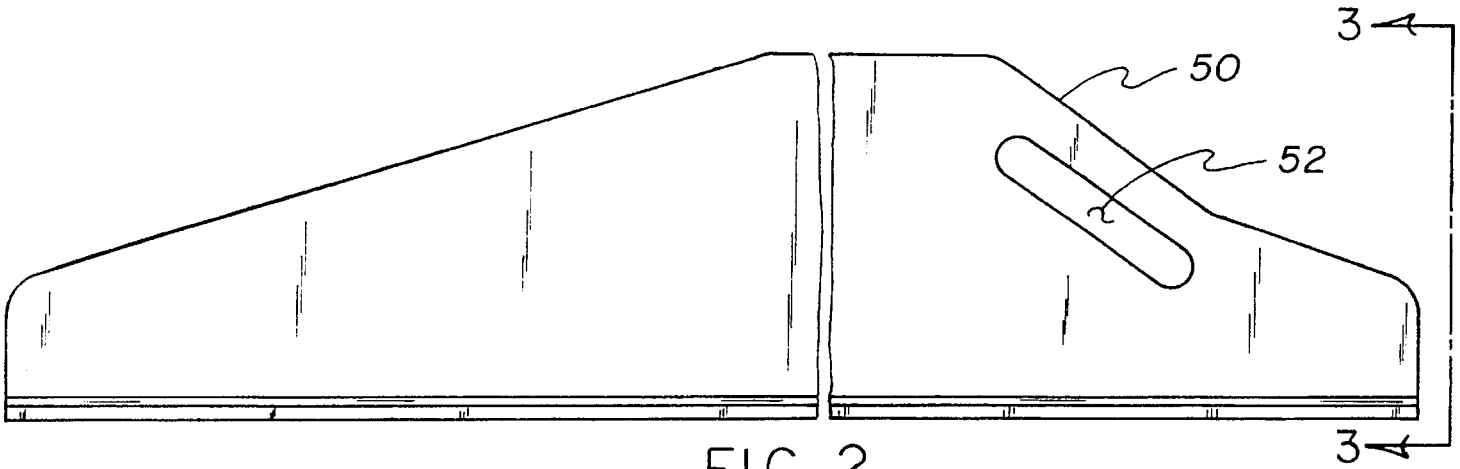
FIG. 2 is an elevation of a guide means comprising a portion of the present invention.
Figure 5:
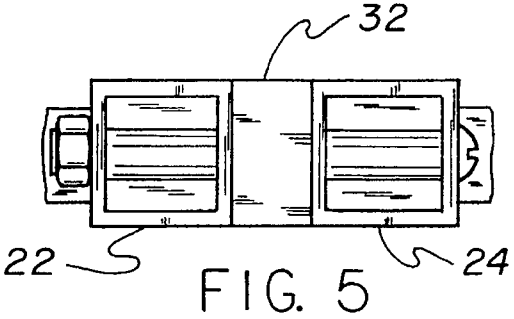
FIG. 5 is an elevation view taken from line 5—5 of FIG. 4.

Referring now to FIGS. 2 and 3, it can be shown that the guide means 12 according to the present invention 10 preferably comprises a substantially planar handle member 50 having a handle aperture 52 directed therethrough permitting passage of digits of a human hand through the planar handle member to facilitate manual manipulation thereof. The planar handle member 50 is shaped so as to define a straight lower edge thereof positionable into abutting engagement with an exposed edge of the drywall panel 14 as shown in FIG. 1A of the drawings. If desired, guide channels 54 can be removably secured to the straight lower edge of the planar handle member 50 for maintaining an engagement of the lower planar handle member against the exposed edge of the drywall panel 14. As shown in FIG. 1C, the guide channels 54 receive the exposed edge of the drywall panel 14 during engagement thereof with the guide means 12. The guide channels 54 are preferably removably coupled to the lower edge of the guide means 12 such that guide channels 54 of various widths can be interchangeably coupled to the lower edge of the planar handle member 50 so as to accommodate various widths of drywall panels 14.

Figure 4:
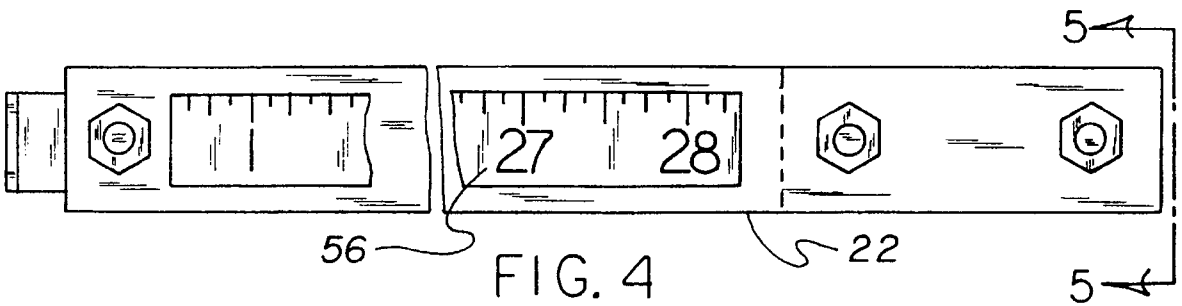
FIG. 4 is an elevation view of a support column comprising a further portion of the present invention.

As best illustrated in FIGS. 1A and 4, it can be shown that the present invention 10 may further comprise a measurement gauge 56 extending along an exterior surface of either or both of support columns 22 and 24 for indicating a distance between the cutting means 18 and the guide means 12. In other words, the measurement gauge 56 operates to indicate to an individual a transverse width of the drywall panel 14 being cut so as to eliminate or expedite measuring of a desired width of the panel to be cut.

In use, the dual side drywall panel cutter 10 according to the present invention can be easily utilized to effect cutting of a drywall panel 14 along opposed faces thereof. The present invention 10 serves to greatly expedite a process of cutting drywall panels 14 to a desired size, and further provides for greater accuracy and alignment between cuts made into the front and rear faces thereof.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A dual side drywall panel cutter comprising:

a guide means for positioning along an exposed edge of a drywall panel, the guide means comprises a substantially planar handle member having a handle aperture directed therethrough permitting passage of digits of a human hand through the planar handle member to facilitate manual manipulation thereof, the planar handle member shaped so as to define a straight lower edge thereof positionable into abutting engagement with an exposed edge of the drywall panel, the guide means further comprises at least one guide channel secured to the straight lower edge of the planar handle member for maintaining an engagement of the lower planar handle member against the exposed edge of the drywall panel, the guide channel removably coupled to the lower edge of the guide means;

a support assembly adjustably coupled to the guide means and extending downwardly therefrom so as to be positionable along opposed faces of the drywall panel, the support assembly comprises a first support column slidably mounted to a front face of the guide means, a second support column slidably mounted to a rear face of the guide means, a first pair of flanges secured to the front face of the guide means in a substantially spaced and parallel orientation, with the first support column extending therebetween, a second pair of flanges secured to the rear face of the guide means in a substantially spaced and parallel orientation, with the second support column extending therebetween, the support columns joined together at upper ends thereof by at least one upper fastener directed therebetween, a spacing block interposed between the upper ends of the support columns so as to position the support columns a predetermined distance apart to accommodate the guide means therebetween, the support assembly movably mounted relative to the guide means, a clamp means for selectively securing a position of the support assembly relative to the guide means, the clamp means comprises a lock lever pivotally mounted relative to the guide means, a cam fixedly secured to the lock lever and positioned for engagement against an individual one of the pair of flanges such that rotation of the lock lever will engage the cam to bias the pair of flanges together and clamp the respective support column therebetween;

cutting means secured to lower ends of the support assembly for engaging and cutting opposed faces of the drywall panel, the cutting means comprises a first blade mounting bracket secured to a lower end of the first support column, a second blade mounting bracket secured to a lower end of the second support column, a first cutting blade secured to the first blade mounting bracket and positioned for engagement against a front face of the drywall panel, a second cutting blade secured to the second blade mounting bracket and oriented so as to project towards the first cutting blade so as to be positioned for engagement with a rear face of the drywall panel, the cutting blades adjustably coupled to the respective mounting brackets such that a distance therebetween can be selectively varied, the cutting means further comprises a first guide wheel rotatably mounted to the first blade mounting bracket and positioned for rolling engagement with the front face of the drywall panel, a second guide wheel rotatably mounted to the second blade mounting bracket so as to be positioned for rolling engagement with a rear face of the drywall panel.

* * * * *